US008005402B2

(12) United States Patent
Watanabe et al.

(10) Patent No.: US 8,005,402 B2
(45) Date of Patent: Aug. 23, 2011

(54) CHARGING DEVICE, IMAGE FORMING APPARATUS AND CHARGING METHOD

(75) Inventors: Takeshi Watanabe, Kanagawa-ken (JP); Masashi Takahashi, Kanagawa-ken (JP); Mitsuaki Kouyama, Tokyo (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 1099 days.

(21) Appl. No.: 11/621,804

(22) Filed: Jan. 10, 2007

(65) Prior Publication Data

US 2008/0166154 A1 Jul. 10, 2008

(51) Int. Cl.
*G03G 15/02* (2006.01)

(52) U.S. Cl. ..... 399/174; 399/175; 399/176

(58) Field of Classification Search ..... 399/174, 399/175–176

See application file for complete search history.

(56) References Cited

U.S. PATENT DOCUMENTS

| | | | | |
|---|---|---|---|---|
| 5,096,795 | A * | 3/1992 | Yu | 430/58.8 |
| 5,395,724 | A * | 3/1995 | Morrison et al. | 430/114 |
| 5,418,605 | A * | 5/1995 | Arahira et al. | 399/174 |
| 5,895,146 | A * | 4/1999 | Waki et al. | 399/170 |
| 6,038,418 | A * | 3/2000 | Chigono et al. | 399/174 |
| 6,081,681 | A * | 6/2000 | Nagase et al. | 399/174 |
| 6,148,165 | A * | 11/2000 | Visser et al. | 399/223 |
| 6,233,419 | B1 * | 5/2001 | Chigono et al. | 399/176 |
| 6,238,759 | B1 * | 5/2001 | Meece et al. | 428/36.9 |
| 6,289,190 | B1 * | 9/2001 | Amamiya et al. | 399/174 |
| 6,298,205 | B1 * | 10/2001 | Chigono et al. | 399/174 |
| 6,381,431 | B1 * | 4/2002 | Kinoshita et al. | 399/175 |
| 6,442,362 | B2 * | 8/2002 | Hirabayashi et al. | 399/149 |
| 6,615,010 | B2 * | 9/2003 | Hirabayashi et al. | 399/174 |
| 6,625,409 | B2 * | 9/2003 | Shakuto et al. | 399/159 |
| 6,728,501 | B2 * | 4/2004 | Sano | 399/168 |
| 6,947,688 | B2 * | 9/2005 | Inoue et al. | 399/174 |
| 7,130,565 | B2 * | 10/2006 | Nakamura et al. | 399/175 |
| 7,184,676 | B2 * | 2/2007 | Ota | 399/50 |
| 7,480,474 | B2 * | 1/2009 | Muto | 399/175 |
| 7,623,812 | B2 * | 11/2009 | Kagawa | 399/176 |
| 2002/0115011 | A1 * | 8/2002 | Komoto et al. | 430/125 |
| 2003/0235419 | A1 * | 12/2003 | Ota | 399/50 |

(Continued)

FOREIGN PATENT DOCUMENTS

JP 2001-051480 2/2001

(Continued)

OTHER PUBLICATIONS

English translation of Ikuno et al. (JP 2001-215745), mailed herewith.*

(Continued)

*Primary Examiner* — David M Gray
*Assistant Examiner* — Geoffrey T Evans
(74) *Attorney, Agent, or Firm* — Turocy & Watson, LLP

(57) ABSTRACT

A technology capable of realizing a stable charging performance in an image forming apparatus employing a contact charging system is provided. A charging device is configured to have a charging member to which a prescribed bias voltage is applied and which comes into contact with an image carrying surface of an image carrier to charge the image carrying surface; and a particle supply section configured to supply a charging auxiliary particle made of a conductive particle having a diamond particle contained therein in a portion coming into contact with the image carrying surface in the charging member.

12 Claims, 9 Drawing Sheets

U.S. PATENT DOCUMENTS

| | | | | |
|---|---|---|---|---|
| 2004/0126691 | A1* | 7/2004 | Tsutsui et al. | 430/108.4 |
| 2008/0107450 | A1* | 5/2008 | Watanabe et al. | 399/175 |
| 2008/0124130 | A1* | 5/2008 | Watanabe et al. | 399/176 |
| 2009/0162100 | A1* | 6/2009 | Hong et al. | 399/175 |
| 2009/0169263 | A1* | 7/2009 | Watanabe et al. | 399/254 |

FOREIGN PATENT DOCUMENTS

| | | |
|---|---|---|
| JP | 2001-215745 | 8/2001 |
| JP | 2002-351195 | 12/2002 |
| JP | 2005-099550 | 4/2005 |
| JP | 2005-326659 | 11/2005 |
| JP | 2006-078928 | 3/2006 |
| JP | 2006-113377 | 4/2006 |

OTHER PUBLICATIONS

English translation of Ishii et al. (JP pub 2006-330496).*
Korean Office Action dated Sep. 25, 2008 corresponding to U.S. Appl. No. 11/621,804 filed on Jan. 10, 2007.

* cited by examiner

FIG. 8

| Test No. | | | Specific resistivity of charging auxiliary particle (Ω·cm) | Photo-conductor | Image state | | | | | | | |
|---|---|---|---|---|---|---|---|---|---|---|---|---|
| | | | | | Initial stage | After printing of 10,000 sheets | After printing of 20,000 sheets | After printing of 30,000 sheets | After printing of 40,000 sheets | After printing of 50,000 sheets | After printing of 60,000 sheets | After printing of 70,000 sheets |
| 1 | Example 1 | External addition of diamond fine particle in zinc oxide particle | 1 × 10e4 | A | ○ | ○ | ○ | ○ | ○ | ○ | ○ | ○ |
| 2 | | | 1 × 10e5 | A | ○ | ○ | ○ | ○ | ○ | ○ | ○ | ○ |
| 3 | | | 1 × 10e6 | A | ○ | ○ | ○ | ○ | ○ | ○ | ○ | ○ |
| 4 | | | 1 × 10e4 | B | a1 | a1 | a1 | a2 | a2 | a2 | a2 | a2 |
| 5 | | | 1 × 10e5 | B | a1 | a1 | a1 | a2 | a2 | a2 | a2 | a2 |
| 6 | | | 1 × 10e6 | B | a1 | a1 | a1 | a2 | a2 | a2 | a2 | a2 |
| 7 | Comparative Example 1 | Only zinc oxide particle | 1 × 10e4 | A | a1 | a1 | a1 | a2 | a2 | a3 | | |
| 8 | | | 1 × 10e4 | B | a3 | | | | | | | |
| 9 | Example 2 | Dispersing treatment of diamond fine particle in polyester resin | 1 × 10e4 | A | ○ | ○ | ○ | ○ | ○ | ○ | ○ | ○ |
| 10 | | | 1 × 10e5 | A | ○ | ○ | ○ | ○ | ○ | ○ | ○ | ○ |
| 11 | | | 1 × 10e6 | B | ○ | ○ | ○ | ○ | ○ | ○ | ○ | ○ |
| 12 | | | 1 × 10e4 | B | a1 | a1 | a1 | a2 | a2 | a2 | a2 | a2 |
| 13 | | | 1 × 10e5 | B | a1 | a1 | a1 | a2 | a2 | a2 | a2 | a2 |
| 14 | | | 1 × 10e6 | B | a1 | a1 | a1 | a2 | a2 | a2 | a2 | a2 |
| 15 | Comparative Example 2 | Diamond fine particle was not added in the foregoing | 1 × 10e4 | A | a1 | a1 | a1 | a2 | a2 | a3 | | |
| 16 | | | 1 × 10e4 | B | a3 | | | | | | | |

FIG. 9

| Test No. | Charging member | Rotation rate of charging member | Image state | | | | | | | |
|---|---|---|---|---|---|---|---|---|---|---|
| | | | Initial stage | After printing of 10,000 sheets | After printing of 20,000 sheets | After printing of 30,000 sheets | After printing of 40,000 sheets | After printing of 50,000 sheets | After printing of 60,000 sheets | After printing of 70,000 sheets |
| 17 | Charging roller | With: 3 times | a1 | a1 | a1 | a2 | a2 | a2 | a2 | a2 |
| 5 | | With: 2 times | a1 | a1 | a1 | a2 | a2 | a2 | a2 | a2 |
| 18 | | With: 1.1 times | a1 | a1 | a1 | a2 | a2 | a2 | a2 | a2 |
| 19 | | With: 1.0 time | a2 | a2 | a2 | a3 | | | | |
| 20 | | Coupled with photoconductor | a2 | a2 | a3 | | | | | |
| 21 | | With: 0.8 times | a1 | a1 | a1 | a2 | a2 | a2 | a2 | a2 |
| 22 | | Against: 0.5 times | a1 | a1 | a1 | a2 | a2 | a2 | a2 | a2 |
| 23 | | Against: 2 times | a1 | a1 | a1 | a2 | a2 | a2 | a2 | a2 |
| 24 | | Against: 3 times | a1 | a1 | a1 | a2 | a2 | a2 | a2 | a2 |
| 25 | Brush roller | With: 2 times | a1 | a1 | a1 | a2 | a2 | a2 | a2 | a2 |

FIG. 10

| Test No. | | Contact angle of supply roller surface (°) | Contact angle of charging roller surface (°) | Contact angle of photoconductor (°) | Image state | | | | | | | |
|---|---|---|---|---|---|---|---|---|---|---|---|---|
| | | | | | Initial stage | After printing of 10,000 sheets | After printing of 20,000 sheets | After printing of 30,000 sheets | After printing of 40,000 sheets | After printing of 50,000 sheets | After printing of 60,000 sheets | After printing of 70,000 sheets |
| 5 | | 90 | 75 | 90 | a1 | a1 | a1 | a2 | a2 | a2 | a2 | a2 |
| 26 | | 90 | 85 | 90 | a1 | a1 | a1 | a2 | a2 | a2 | a2 | a2 |
| 27 | | 80 | 85 | 90 | a1 | a2 | a2 | a2 | a2 | a3 | | |
| 28 | | 90 | 75 | 80 | a1 | a1 | a1 | a2 | a2 | a2 | a2 | a2 |
| 29 | | 90 | 85 | 80 | a1 | a2 | a3 | | | | | |
| 30 | | 80 | 85 | 80 | a1 | a3 | | | | | | |

FIG. 12

| Test No. | | | Photo-conductor | Image state | | | | | | Film shaving amount of photoconductor after printing of 50,000 sheets |
|---|---|---|---|---|---|---|---|---|---|---|
| | | | | Initial stage | After printing of 10,000 sheets | After printing of 20,000 sheets | After printing of 30,000 sheets | After printing of 40,000 sheets | After printing of 50,000 sheets | |
| 31 | Comparative Example 1 | Only zinc oxide particle | A | a1 | a1 & b1 | a2 & b2 | a3 & b3 | | | |
| 32 | | | B | a3 | | | | | | |
| 33 | Example 2 | External addition of diamond fine particle in zinc oxide particle | A | ○ | ○ | ○ | a1 | a1 | a2 | |
| 34 | | | B | a1 | a2 | a2 | a2 | a2 | a2 | 1.1 μm |
| 35 | | | a-Si | a1 | a2 | a2 | a2 | a2 | a2 | 0.1 μm |
| 36 | | | Chain polymerization photoconductor | a1 | a2 | a2 | a2 | a2 | a2 | 0.2 μm |
| 5 | | | B | a1 | a1 | a1 | a2 | a2 | a2 | 2.2 μm |

CHARGING DEVICE, IMAGE FORMING APPARATUS AND CHARGING METHOD

BACKGROUND OF THE INVENTION

1. Field of the Invention

The present invention relates to a contact charging system in an image forming apparatus and in particular, relates to stabilization of a charging performance.

2. Description of the Related Art

In recent years, injection charging which is a charging system not accompanied with discharging is watched as a charging system on an image carrier surface in an image forming apparatus.

The injection charging is excellent in charging efficiency. For example, in non-contact charging, in order to charge a surface of a body to be charged at −500 V, it is required to apply a bias of approximately −800 to 1,200 V to a charging unit, whereas in the injection charging, only a bias of approximately −500 to −700 V is necessary and it does not follow the Paschen's law of discharging, and therefore, the generation of ozone due to discharging is remarkably low.

Also, in recent years, a method of using a charging auxiliary particle is proposed as a method of stably performing injection charging. This stabilizes charging characteristics by mediating a charging auxiliary particle between an elastic roller or a brush roller and a photoconductor, and in general, the injection charging efficiency is improved by using a particle having a smaller particle size than a toner and having low resistivity.

For example, JP-A-2005-326659 discloses an example for improving the efficiency of injection charging by combining a charging member having a specified expanded cell and a conductive charging auxiliary particle. Here, the charging auxiliary particle is externally added to a toner in a development unit in advance, and since the charging auxiliary particle is a conductive particle, it remains on the photoconductor without being transferred in a transfer step. In addition, the disclosed example is concerned with a cleaner-less process not having a photoconductor cleaner, and after it has functioned as a charging auxiliary particle in a charging section, the particle is recovered in a development section.

Also, JP-A-2005-99550 discloses an example for applying a charging auxiliary particle to a brush charging roller.

This example is concerned with a system in which a charging auxiliary particle is contained in a brush in advance and the charging auxiliary particle is not externally added in a toner in advance. Furthermore, this example is concerned with a configuration provided with a photoconductor cleaner, the resistivity of the charging auxiliary particle is also set up on a lower level than the toner, and the injection charging is carried out by the charging auxiliary particle.

As described above, though some examples of using a charging auxiliary particle have been proposed, there are still involved the following problems.

(1) In all of these examples, a charging performance of injection charging itself is insufficient, and when a halftone image or the like is printed, there may be a possibility that streak unevenness is generated due to charging unevenness.

(2) In the system of externally adding a conductive particle in a toner in advance, the charging characteristics of the toner are deteriorated by the charging auxiliary particle, and an image with high image quality cannot be obtained as compared with the case where the charging auxiliary particle is not present.

(3) In the system of not mixing a charging auxiliary particle in a toner, since even a trace amount of the charging auxiliary particle is always released from a charging unit, the charging auxiliary particle intermixes into a development unit, thereby deteriorating the charging characteristics of the toner. Thus, when used over a long period of time, the image quality is deteriorated.

SUMMARY OF THE INVENTION

Embodiments of the invention are aimed to provide a technology capable of realizing a stable charging performance in an image forming apparatus employing a contact charging system.

In order to solve the foregoing problems, a charging device according to an embodiment of the invention is configured to have a charging member to which a prescribed bias voltage is applied and which comes into contact with an image carrying surface of an image carrier to charge the image carrying surface; and a particle supply section configured to supply a charging auxiliary particle made of a conductive particle having a diamond particle contained therein in a portion coming into contact with the image carrying surface in the charging member.

Also, a charging device according to an embodiment of the invention is configured to have a charging means to which a prescribed bias voltage is applied and for coming into contact with an image carrying surface of an image carrier to charge the image carrying surface; and a particle supply means for supplying a charging auxiliary particle made of a conductive particle having a diamond particle contained therein in a portion coming into contact with the image carrying surface in the charging means.

Also, a charging method according to an embodiment of the invention is configured to include supplying a charging auxiliary particle made of a conductive particle having a diamond particle contained therein in a portion of a charging member coming into contact with an image carrying surface of an image carrier which comes into contact with the image carrying surface to charge the image carrying surface; and applying a prescribed bias voltage to the charging member in a state that the charging auxiliary particle is mediated between the charging member and the image carrier, thereby charging the surface of the image carrier.

DESCRIPTION OF THE DRAWINGS

FIG. 8 is a table to show the results of comparison and review of a charging performance.

FIG. 9 is a table to show the results of comparison and review of a charging performance.

FIG. 10 is a table to show the results of comparison and review of a charging performance.

FIG. 12 is a table to show the results of comparison and review of a charging performance.

DESCRIPTION OF THE EMBODIMENTS

Embodiments of the invention are hereunder described with reference to the accompanying drawings.

Figure 1:
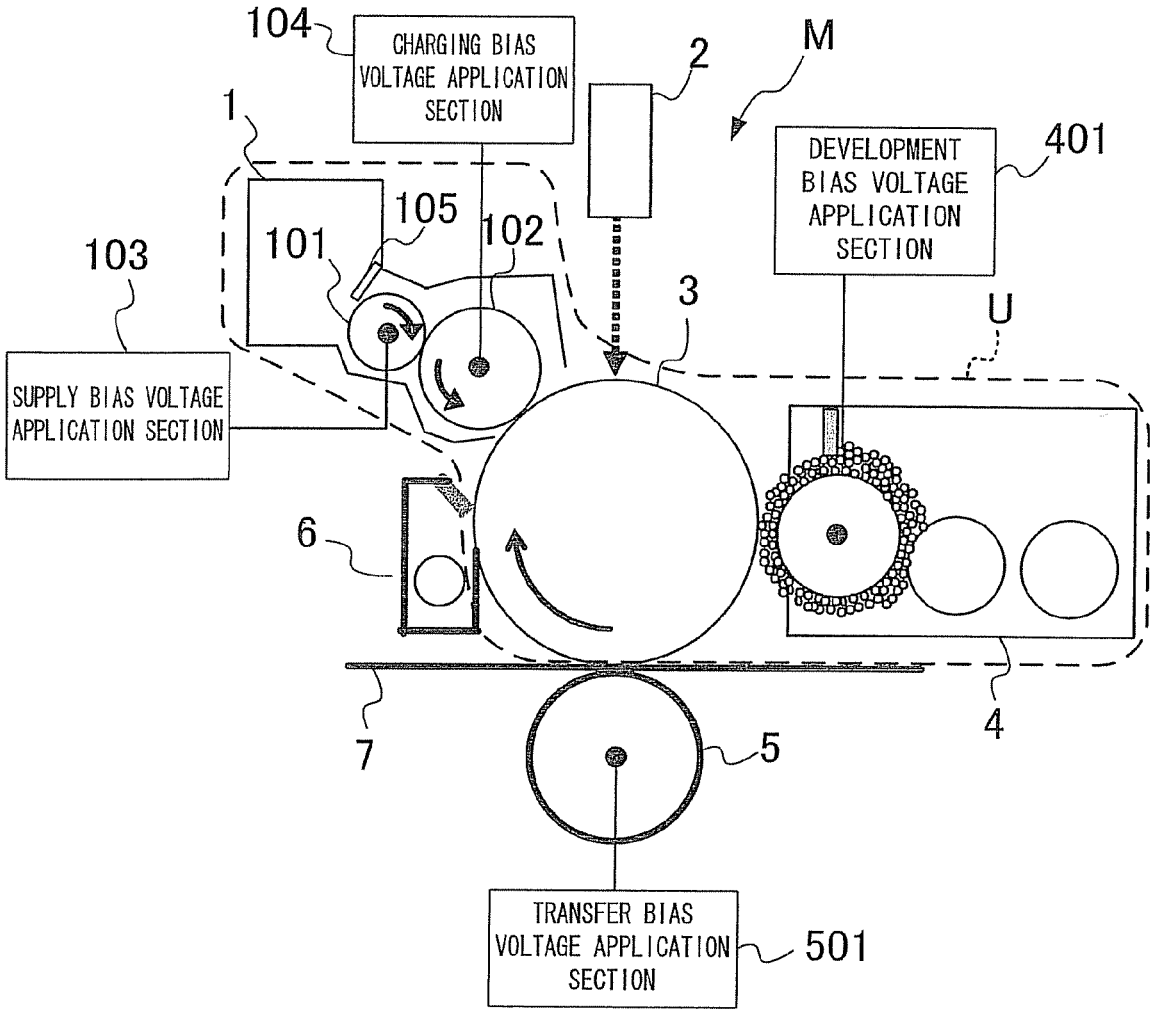
FIG. 1 is a view to show a configuration of an electrophotographic apparatus (image forming apparatus) M provided with a charging device 1 of a contact charging system according to an embodiment of the invention.

FIG. 1 is a view to show a configuration of an electrophotographic apparatus (image forming apparatus) M provided with a charging device 1 of a contact charging system according to an embodiment of the invention.

A photoconductive drum (image carrier) 3 has a cylindrical shape having a diameter of 30 mm and is provided rotatably to a direction illustrated by an arrow. The following are arranged in the surroundings of the photoconductive drum 3 along the rotation direction. First of all, the charging device 1 is provided opposing to a surface of the photoconductive drum 3 (image carrier surface). This charging device 1 uniformly negatively charges the photoconductive drum 3 by a contact charging system. An exposure position at which the charged photoconductive drum 3 is exposed by an exposure device 2 to form an electrostatic latent image is established in a downstream side than the charging device 1 in a movement direction of the photoconductive surface. Furthermore, a development unit 4 which accommodates a developing agent therein and reversely develops the electrostatic latent image formed by the exposure device 2 with this developing agent is provided at a prescribed development position in a downstream side than the exposure position in the movement direction of the photoconductive surface. In the development unit 4, a prescribed development bias voltage is applied to a development roller by a development bias voltage application section 401.

In addition, a prescribed primary transfer position at which a color toner image formed on the photoconductive drum 3 is subjected to primary transfer into an intermediate transfer belt 7 is established in a downstream side than the development position in the movement direction of the photoconductive surface. A transfer roller 5 to which a prescribed transfer bias voltage is applied by a transfer bias voltage application section 501 presses the intermediate transfer belt 7 towards the photoconductive drum 3 at the foregoing primary transfer position. When a color image is formed on the intermediate transfer belt 7 at the primary transfer position, a developing agent image formed on the intermediate transfer belt 7 is collectively transferred onto paper which has been carried at a non-illustrated secondary transfer position. A toner recovery section 6 for recovering a transferred residual toner remaining on the photoconductive surface of the photoconductive drum 3 is provided in a downstream side than a contact position (primary transfer position) between the photoconductive drum 3 and the intermediate transfer belt 7 in the movement direction of the photoconductive surface.

Subsequently, details of the charging device 1 according to the present embodiment are described. The charging device 1 according to the present embodiment is provided with a supply roller 101, a charging roller 102, a supply bias voltage application section 103, a charging bias voltage application section 104, and a layer thickness regulating blade 105.

The charging roller (charging member or charging unit) 102 is a rotatably supported roller to which a prescribed charging bias voltage is applied by the charging bias voltage application section 104 and comes into contact with the photoconductive surface of the photoconductive drum 3 for the purpose of charging the photoconductive surface.

The supply roller 101 is a rotatably supported roller to which a prescribed supply bias voltage is applied by the supply bias voltage application section 103 and supplies a charging auxiliary particle made of a conductive particle having a diamond particle (particle having a prescribed negative electronegativity) contained therein to a portion coming into contact with the photoconductive surface of the charging roller. Here, the supply roller 101 and the supply bias voltage application section 103 are corresponding to a particle supply section (particle supply unit).

Thus, by taking a configuration in which the charging auxiliary particle is mediated between the bias applied charging roller and the photoconductive surface of the photoconductive drum 3, it is possible to improve the charging efficiency of the photoconductive surface of the photoconductive drum 3.

Figure 2:
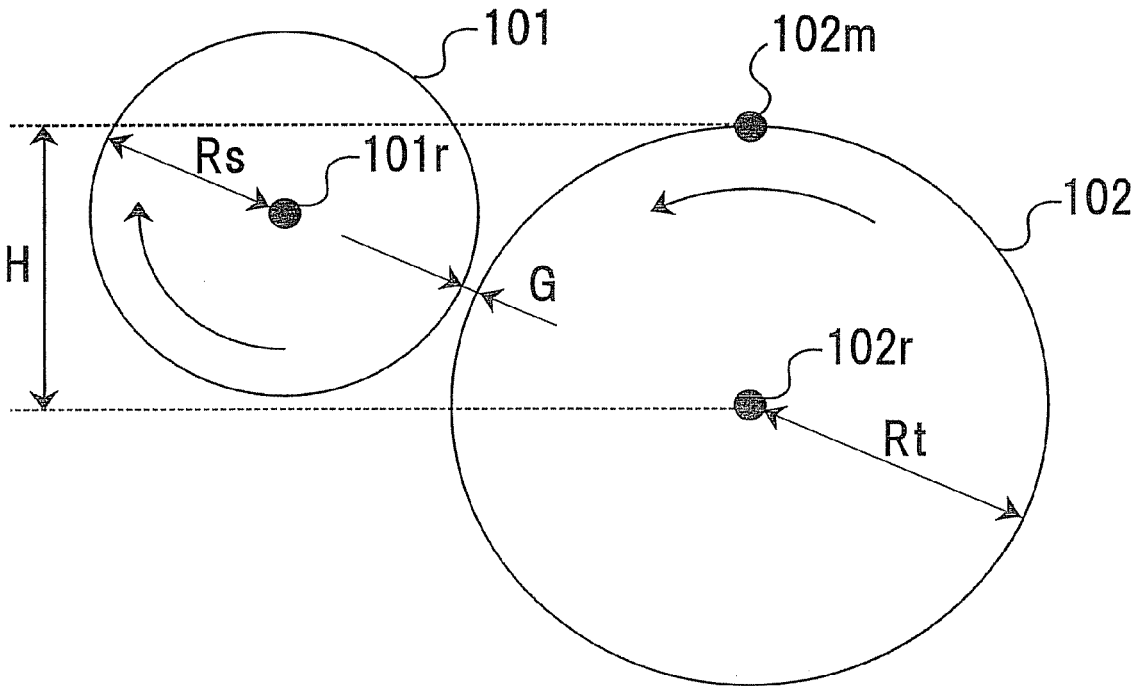
FIG. 2 is a view to show details of the positional relationship between a supply roller 101 and a charging roller 102 in the charging device 1 according to the present embodiment.

FIG. 2 is a view to show details of the positional relationship between the supply roller 101 and the charging roller 102 in the charging device 1 according to the present embodiment.

As illustrated in FIG. 2, in the present embodiment, the supply roller 101 is rotated and driven in such a manner that a roller surface of the supply roller 101 and a roller surface of the charging roller 102 move in the same direction (so-called "with" direction) in a portion close to the charging roller 102. Thus, by rotating the supply roller 101 and the charging roller 102 in the "with" direction, it is possible to inhibit the degradation of the charging roller caused due to abrasion between the both rollers and to improve the durability of the suppler roller 101 and the charging roller 102.

Incidentally, the supply roller 101 may be rotated in a coupled driving manner against the charging roller 102 or may be provided with a circumferential speed difference of from approximately 0.5 to 3 times. However, for the purpose of improving the durability of the suppler roller 101 and the charging roller 102, the suppler roller 101 and the charging roller 102 may also be rotated and driven in such a manner that the circumferential speed is substantial equal.

As described later, since a contact angle of the roller surface of the supply roller 101 against water is set up larger than a contact angle of the roller surface of the charging roller 102 against water, the charging auxiliary particle easily moves from the supply roller 101 to the charging roller. In this way, in the case where the contact angles of the both rollers are made largely different from each other, since the charging auxiliary particle is easily separated from the supply roller 101, it is desirable that the conveyance of the charging auxiliary particle from the supply roller 101 to the charging roller 102 does not resist gravity as far as possible. Furthermore, when the supply roller 101 is arranged at an excessively high position against the charging roller 102, there may be a possibility that space saving is disturbed as a whole of the apparatus.

Then, a rotation axis 101*r* of the supply roller 101 is arranged at a position (within a range H in FIG. 2) higher than a rotation axis 102*r* of the charging roller 102 but lower than a maximum arrival position 102*m* of the outer periphery of the charging roller 102 in a height direction.

Incidentally, here, when a radius of the supply roller 101 is defined as Rs and a radius of the charging roller 102 is defined as Rt, (Rt/Rs) is set up so as to fall within the range of from 1 to 1.6.

Furthermore, when a gap between the roller surface of the supply roller 101 and the roller surface of the charging roller 102 in a position at which the both rollers are close to each other is defined as G and a diameter of the charging auxiliary particle is defined as Td, the following relationship is set up.

$$G \leqq (2 \times Td)$$

When the supply roller 101 and the charging roller 102 are excessively separated from each other, it is impossible to form a layer of the charging auxiliary particle in an appropriate layer thickness. However, by taking the foregoing configuration, it is possible to form a thin layer of the charging auxiliary particle in a layer thickness of not more than 2 times of the diameter of the charging auxiliary particle. The charging roller and the supply roller may come into contact with each other. However, when a contact pressure is high, a strain or a problem from the viewpoint of durability is caused. Accordingly, though it may be desired to make the charging roller and the supply roller close to each other as far as possible, it is not preferable that the both rollers are separated from each other exceeding the range specified by the foregoing expression. Accordingly, the both rollers are adjusted in such a manner that the condition specified by the foregoing expression is kept from the contact state while taking into consideration eccentricity of the both rollers or the like.

Figure 3:
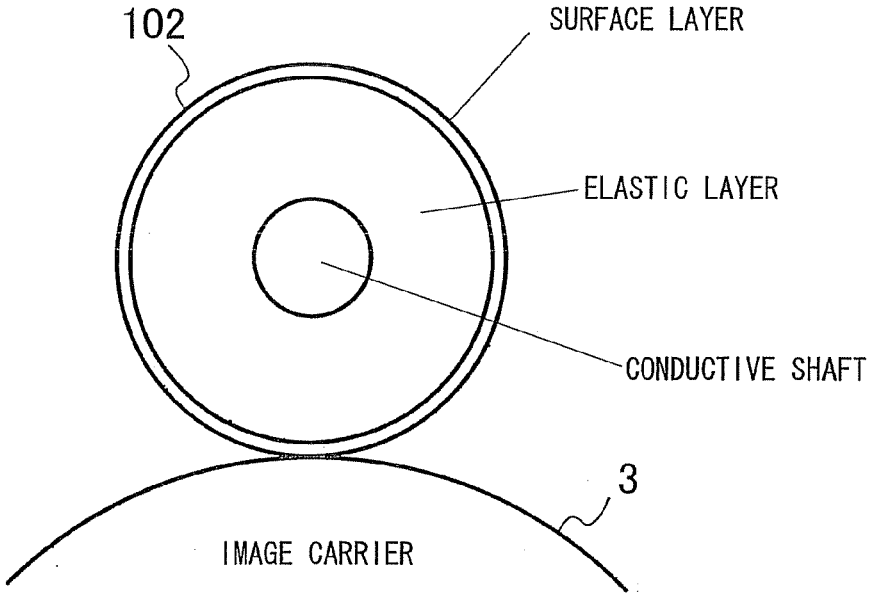
FIG. 3 is a view to show details of a configuration of a charging roller 102 in the present embodiment.

FIG. 3 is a view to show details of a configuration of the charging roller 102 in the present embodiment. As illustrated in FIG. 3, the charging roller 102 of the present embodiment has an elastic layer made of a conductive urethane or the like in the periphery of a conductive shaft (rotation axis) and further has a layer made of a conductive resin or elastomer as a surface layer in the outside of the elastic layer.

Concretely, any elastomers such as synthetic rubbers and thermoplastic elastomers may be used as a material of the elastic layer. Examples of the resin include fluorocarbon resins, polyamide resins, acrylic resins, polyurethane resins, silicone resins, butyral resins, styrene/ethylene.butyl-ene/olefin copolymers (SEBC), and olefin/ethylene.butyl-ene/olefin copolymers (CEBC). Furthermore, examples of the elastomer include synthetic rubbers and thermoplastic elastomers. Examples of the synthetic rubber include natural rubbers (for example, vulcanized rubbers), epichlorohydrin rubbers, EPDM, SBR, silicone rubbers, urethane rubbers, IR, BR, NBR, and CR. Examples of the thermoplastic elastomer include polyolefin based thermoplastic elastomers, urethane based thermoplastic elastomers, polystyrene based thermoplastic elastomers, fluorocarbon rubber based thermoplastic elastomers, polyester based thermoplastic elastomers, polyamide based thermoplastic elastomers, polybutadiene based thermoplastic elastomers, ethylene vinyl acetate based thermoplastic elastomers, polyvinyl chloride based thermoplastic elastomers, and chlorinated polyethylene based thermoplastic elastomers. These materials may be used singly or in admixture of two or more kinds thereof or may be a copolymer.

Furthermore, an expanded material obtained by expansion molding of such an elastic material may be used as the elastic material. Preferably, for the purpose of ensuring a nip between the charging member and the photoconductor, it may be said to be better to use a synthetic rubber material for the elastic layer material.

It is preferable that the conductivity of the elastic layer is adjusted at less than 10e8 Ω·cm by properly adding a conductive agent such as carbon black, conductive metal oxides, alkali metal salts, and ammonium salts in the foregoing elastic material. When the conductivity of the elastic layer is 10e8 Ω·cm or more, a charging performance of the charging member becomes low, and the charging uniformity for uniformly charging a body to be charged is lowered. In that case, charging unevenness is often caused, thereby generating image failure. Furthermore, the elasticity and hardness of the elastic layer are adjusted by adding a softening oil, a plasticizer, etc. by expanding the foregoing elastic material.

Subsequently, with respect to a material of the surface layer, any resins or elastomers may be basically used, and the same materials as those in the elastic layer in the present embodiment can be used.

In addition, in the surface layer, various conductive fine particles may be added to adjust its volume resistivity at a desired value. As the conductive fine particle, those as described above can be used, and two or more kinds thereof may be used jointly. Moreover, for the purposes of controlling surface properties and improving reinforcement properties, a fine particle of titanium oxide or the like can also be used. A mold releasing substance may further be contained in the surface layer. A resistivity of the surface layer of from approximately 10e4 to 10e14 Ω·cm can be employed. It has hitherto been said that leakage of the photoconductor is liable to be caused unless the resistivity of the surface layer is the resistivity value of the elastic layer or more. However, in the present embodiment, since charging is carried out by injection charging and the applied voltage is extremely reduced as compared with that of the related art, even when the resistivity of the surface layer is low, a leakage hardly occurs.

Incidentally, the configuration of the charging roller is not limited to the foregoing configuration, but it may be of a three-layered structure in which a resistance layer or the like is further provided between the elastic layer and the surface layer or may be of a multilayered structure.

Figure 4:
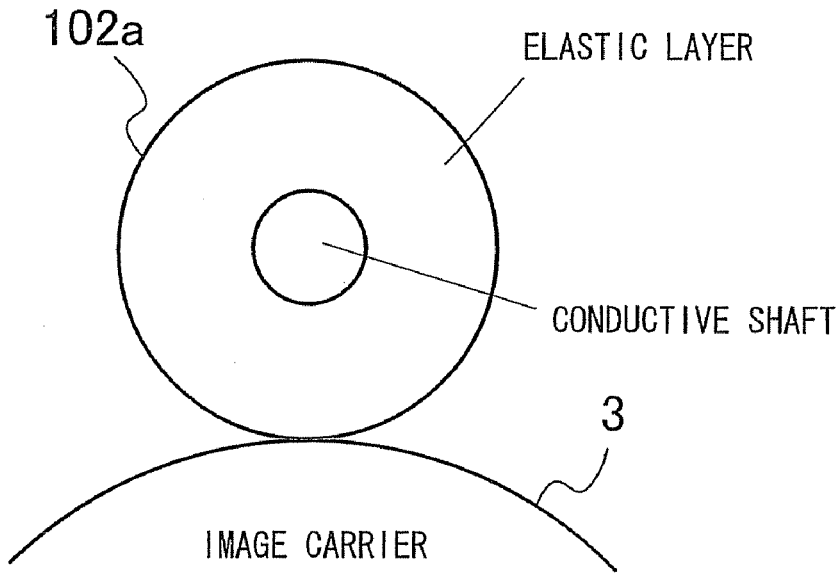
FIG. 4 is a view to show details of other configuration of a charging roller in the present embodiment.

Furthermore, the charging roller may be a charging member 102*a* in a roller shape as illustrated in FIG. 4, which is configured to provide only an elastic layer on a support without especially providing a surface layer.

Figure 5:
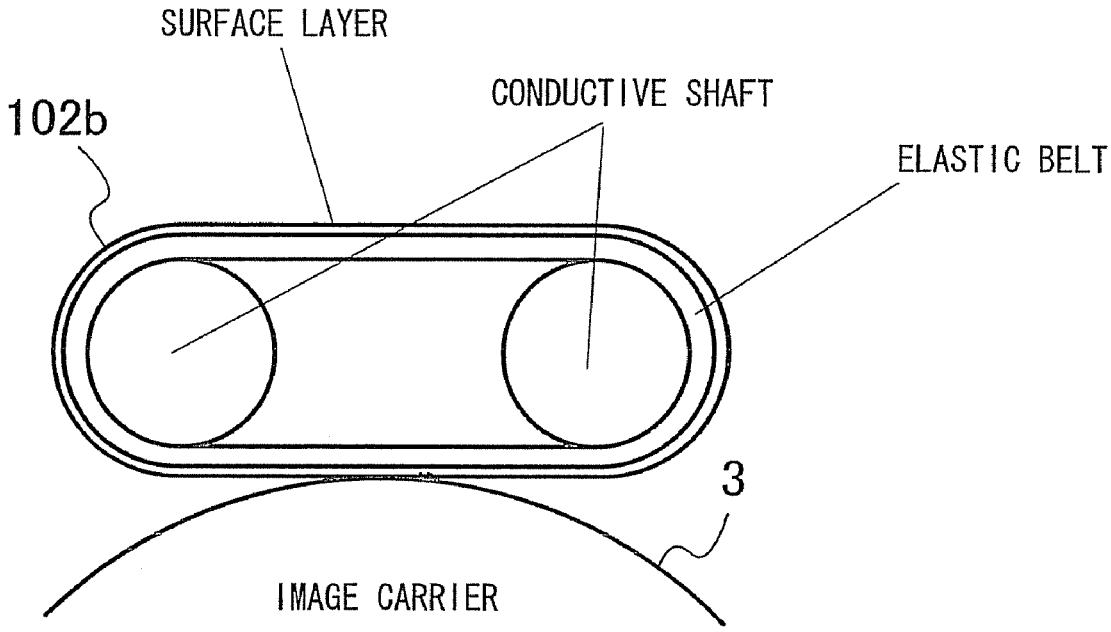
FIG. 5 is a view to show details of other configuration of a charging roller in the present embodiment.

As a matter of course, the shape of the charging member is not limited to the roller shape but can be a charging member 102*b* in a belt shape as illustrated in FIG. 5.

Figure 6:
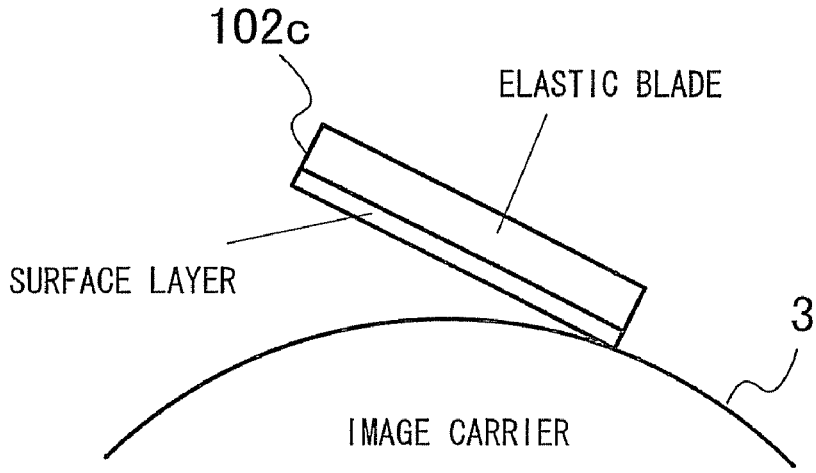
FIG. 6 is a view to show details of other configuration of a charging roller in the present embodiment.
Figure 7:
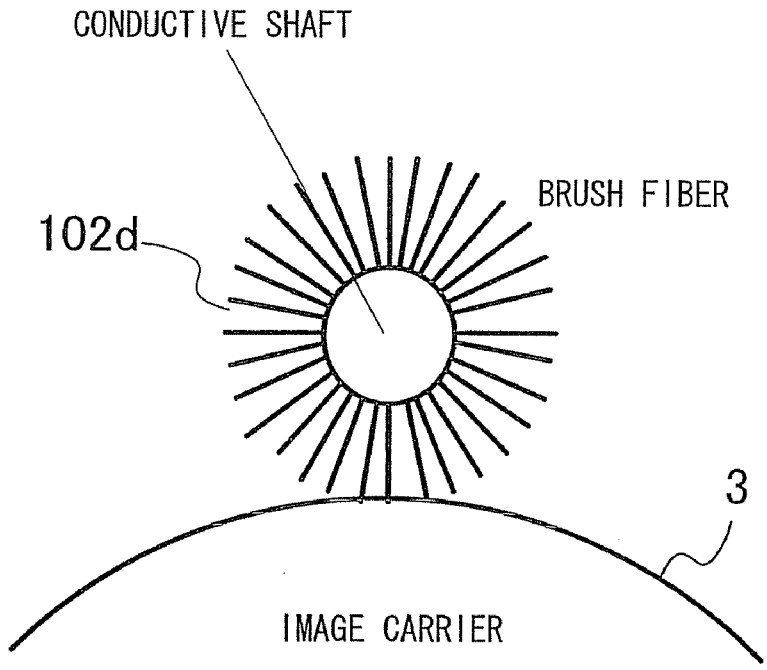
FIG. 7 is a view to show details of other configuration of a charging roller in the present embodiment.

Besides, the shape of the charging member may be a charging member 102*c* in a blade shape as illustrated in FIG. 6 corresponding to a required performance, an arrangement space, and the like or may be a charging member 102*d* in a brush roller shape as illustrated in FIG. 7.

A unit for supplying the charging auxiliary particle onto the charging roller 102 is, for example, of a type in which the layer thickness regulating blade 105 is provided in the supply roller 101; and when a uniform layer of the charging auxiliary particle is provided on the supply roller 101 and comes into contact with the charging roller 102, the charging auxiliary particle is supplied onto the charging roller 102. As described previously, though the surface layer is provided on the surface of the charging roller 102, by making its surface energy lower than that of the photoconductive surface, the charging auxiliary particle does not move onto the photoconductive drum 3. In addition, by making the surface energy on the surface of the supply roller 101 for supplying the charging auxiliary particle onto the charging roller 102 higher than that of the charging roller 102, the charging auxiliary particle can be stably supplied onto the charging roller 102.

Though the rotation direction is not particularly limited, with respect to a circumferential speed difference between the charging roller 102 and the photoconductive drum 3, provided that the driving is preferably performed in a separate driving manner but not a coupled driving manner and in the "with" direction, it is better that a circumferential speed is set up at 1.1 to 4 times of a circumferential speed of the photoconductor. Even when the circumferential speed of the charging roller 102 is equal to or slower than that of the photoconductive drum 3, the effects could be brought. However, it is preferable from the viewpoint of stability of the injection charging that the circumferential speed of the charging roller 102 is faster. However, when the circumferential speed of the charging roller 102 is set up at more than 4 times of that of the photoconductive drum 3, the charging auxiliary particle tends to be easily separated.

In a portion where the photoconductive drum 3 and the charging roller 102 come into contact with each other, in the case where the photoconductive drum 3 and the charging roller 102 are rotated and driven in such a manner that the photoconductive surface of the photoconductive drum 3 and the roller surface of the charging roller 102 move in a reverse direction (so-called "against" direction) to each other, it is preferable that a circumferential speed of the charging roller is from approximately 0.5 to 3 times of a circumferential speed of the photoconductive drum. This is because when the circumferential speed of the charging roller 102 is less than 0.5 times of that of the photoconductive drum 3, the stability of the injection charging becomes possibly unstable, whereas when the circumferential speed of the charging roller 102 is fast to an extent that it exceeds 3 times of that of the photoconductive drum 3, the charging auxiliary particle tends to be easily separated.

In the present embodiment, a direct current bias voltage of from −400 to −1,100 V is applied to the charging roller 102 by the charging bias voltage application section 104, and a resistivity value of the charging auxiliary particle containing a diamond fine particle of from 1×10e2 to 1×10e12 Ω·cm (more desirably from 1×10e3 to 1×10e8 Ω·cm) is employed. When the resistivity is low, the charging auxiliary particle remains on the charging roller 102 due to the foregoing relationship of surface energy; and in a region where the resistivity is high to a some extent, since a probability that the particle itself is charged to positive polarity is low because of the intensity of electron donating properties with negative polarity as a characteristic feature of the diamond fine particle, the particle itself can remain on the surface of the charging roller 102.

Incidentally, the electrical resistivity of the particle was measured in the following manner. That is, a tool prepared by boring a hole of 1 $cm^2$ in a columnar shape on an insulating plate having a thickness of 1 cm was installed on a metal electrode, and the fine particle was filled in that hole. An electrode having a size substantially the same as the hole and also serving as a weight was placed thereon; and 250 V was applied in a state of applying a load of 1 kg, thereby measuring the resistivity.

Incidentally, it is not necessary that the bias voltage to be applied to the charging member represented by the charging roller 102 is limited to only a DC voltage, but an AC voltage can also be superimposed. In particular, it is already known that by applying a peak-to-peak voltage of two times or more of a discharging initiation voltage, uniform charging can be achieved by discharge even in a state free from the charging auxiliary particle. Even by applying such a bias voltage, a stable charging performance is obtainable although the discharging is slightly caused.

Subsequently, a manufacturing method of a charging auxiliary particle which is used in the present embodiment is hereunder described. The charging auxiliary particle was prepared in the following manner.

(1) External Addition:

A cluster diamond having a nominal primary particle size of from 3 to 10 nm was used as the diamond fine particle. For example, a product of New Metal and Chemicals can be used as the diamond fine particle. The shape may be spherical. Since the diamond particle is usually manufactured by a blasting method, it contains a lot of impurities, and its particle size distribution is relatively broad. Then, first of all, the following purification treatment was carried out.

First of all, as a treatment with hot concentrated sulfuric acid, the diamond particle was rinsed with a mixed liquid of concentrated nitric acid and concentrated sulfuric acid at 250 to 350° C. for 2 hours and then rinsed with dilute hydrochloric acid at 150° C. for one hour. Thereafter, the diamond particle was rinsed with hydrofluoric acid in a normal temperature state for one hour, thereby removing the impurities.

Thereafter, the resulting diamond particle was dispersed in a mixed solution of pure water and an alcohol to form a colloid solution, which was then treated by a centrifuge to extract a supernatant, followed by drying to form a powder.

The thus purified diamond fine particle had an average particle size inclusive of a secondary particle size of not more than 100 nm and subjected to external addition treatment in an amount of from 1 to 10 parts by weight to, for example, 100 parts by weight of a conductive zinc oxide particle (conductive particle) (average particle size: 1.2 μm, specific resistivity: about 1×10e3 Ω·cm). As a result, the specific resistivity as the charging auxiliary particle became 1×10e4 to 1×10e6 Ω·cm.

(2) Internal Addition:

Furthermore, in addition to the above, the charging auxiliary particle can be prepared by adding carbon black and a diamond fine particle in a resin such as polyesters and styrene-acrylic copolymers and kneading and pulverizing the mixture.

According to this method, since the diamond fine particle is dispersed in the resin base together with other conductive agents, it is not easily separated from the charging auxiliary particle. In the experiment, by dispersing carbon black and a diamond fine particle in a polyester resin and varying the amount of carbon black and a pulverization condition, a charging auxiliary particle having an average particle size of 1 μm and a specific resistivity of from 1×10e4 Ω·cm to 1×10e6 Ω·cm was prepared. Incidentally, when the resistivity was the same as in the sample of (1), the diamond fine particle was prepared by adjusting the addition amount of the diamond fine particle such that it was the same addition amount of the diamond fine particle.

COMPARATIVE EXAMPLES

Samples were prepared as the Comparative Examples in the same manners as in (1) or (2), except that the diamond fine particle was not externally added or internally added.

At that time, for the purpose of performing the comparison while making the resistivity value of the zinc oxide particle common, one having a resistivity of 1×10e4 Ω·cm even in a state of not externally adding a diamond fine particle was used.

A negatively charged organic photoconductor was used as the photoconductor.

The photoconductor is, for example, configured such that on an aluminum-made drum having a diameter of 30 mm, a subbing layer as a first layer, a positive charge injection preventing layer as a second layer, a charge generation layer as a third layer and a charge transport layer as a fourth layer are stacked in this order from the aluminum base layer side. Though this is a general organic photoconductor of a function separation type, it does not substantially limit the configuration of the invention. It is also possible to use an organic, ZnO, selenium or amorphous silicon (a-Si) photoconductor of a single layer type.

In the related-art injection charging, it is general to further provide a charge injection layer as a fifth layer. As the charge injection layer, for example, one prepared by dispersing an $SnO_2$ ultrafine particle in a photocurable acrylic resin is enumerated. Concretely, a charge injection layer prepared by dispersing an $SnO_2$ particle having an average particle size of about 0.03 μm resulting from doping with antimony to reduce its resistivity in a proportion of 5/2 in terms of a weight ratio to the resin and the like are disclosed. Actually, it is considered that a volume resistivity value of the charge injection layer varies with the dispersion amount of conductive $SnO_2$ and that in order to meet a condition for not causing image deletion, a resistivity value of the charge injection layer is desirably from 1×10e8 Ω·cm to 10e15 Ω·cm. As the photoconductor for the Comparative Examples of the invention, one in which the charge injection layer had a volume resistivity value of 1×10e12 Ω·cm was used. The resistivity value of the charge injection layer was measured by coating the charge injection layer on an insulating sheet, followed by measuring at an applied voltage of 100 V by HIRESTA, manufactured by Mitsubishi Petrochemical Co., Ltd.

The thus prepared coating solution was coated in a thickness of about 3 μm by a dipping coating method to form a charge injection layer. As the photoconductor for the Comparative Examples, the following were used.

Photoconductor A: Organic photoconductor having up to the fourth layer but not having a charge injection layer Photoconductor B: Organic photoconductor having the foregoing charge injection layer provided on the photoconductor A.

By using the foregoing samples, a direct current bias of from −500 to −1,100 V was applied to the charging member under constant voltage control.

The applied voltage was properly adjusted in such a manner that a halftone or the like became a constant reflection density on average.

FIG. 8 is a table to show the results of comparison and review of a charging performance under each of the foregoing conditions.

As to the experiment, a continuous printing test was carried out in the experimental apparatus as illustrated in FIG. 1. The experiment was carried out in such a manner that the charging roller 102 was gear driven and that a difference in speed of 2 times was given to the contact section of the photoconductor in the "with" direction.

The charging auxiliary particle was coated on the roller surface of the charging roller 102 while bringing the supply roller 101 into contact with the charging roller 102. The supply roller 101 was driven in the "with" direction against the charging roller 102 at an equal rate in the contact section and brought into contact with a 0.2 mm-thick blade made of a metal (SUS) as the layer thickness regulating blade 105. A contact angle of the supply roller 101 against water was 90°; a contact angle of the surface of the charging roller 102 against water was 75°; and a contact angle of the surface of the photoconductor against water was 90°. The measurement of the contact angle against water was carried out by dropping pure water on the surface of each of the samples by using a syringe and measuring a contact angle after standing for 10 seconds in a normal temperature environment (at 21° C. and 50%) by using a microscope.

With respect to the evaluation method of image, three kinds of halftone image having a number screen lines of 212 by multi-level screen with 600 dpi (image density: about 0.3, 0.5 and 0.8), an entire white image and an entire black (solid) image were respectively printed on the entire surface of A3-size paper, image streaks caused due to charging unevenness and image defects caused due to a pinhole of the photoconductor were visually confirmed.

With respect to the procedures, after confirming an image in an initial state of a charging unit, an action of developing a character chart with a printing rate of 4% is developed on the photoconductor and recovering it by a photoconductor cleaner in a state that paper is not passed is carried out corresponding to 10,000 sheets of A4-size paper; and thereafter, paper is passed, thereby performing the foregoing image confirmation. With respect to a combination in which a fault is not caused on the image, the subject test was repeated, thereby carrying out the test corresponding to 70,000 sheets of paper in total.

In FIG. 8, the case where streaks due to charging unevenness were generated is designated as "a"; and the case where a leakage was generated on the photoconductor to cause image defects due to a pinhole is designated as "c". In particular, with respect to "a", the level was graded and evaluated on three grades by visual observation on a basis of the generation state. Here, "level 1" and "level 2" were each actually on a substantially non-conspicuous level, and the test was continued; and "level 3" was on a level where so-called image defects were caused such that a user recognizes it "NG" due to the life or the like, and the test was discontinued at that stage. With respect to the respective levels, the case where a difference (ΔID) in reflection density on the image from which local defects such as a pinhole of the photoconductor and exposure obstacles between a maximum value and a minimum value is 0.3 or more or streaks are distinctly conspicuous by visual observation was designated as "level 3". The case where not only ΔID is in a relationship of ($0.15<\Delta ID<0.3$), but also the generation of streaks is tolerable by visual observation was designated as "level 2". Furthermore, the case where while the generation of streaks is recognized by minute observation, ΔID is in a relationship of ($\Delta ID<0.15$) is designated as "level 1", and the case where the generation of streaks due to charging unevenness cannot be discriminated is designated as "○". In the table as shown in FIG. 8, the level 1, level 2 and level 3 are set forth as "a1", "a2" and "a3", respectively. Moreover, with respect to "c" of the pinhole, the case where the generation of a pinhole was confirmed even slightly by visual observation is recognized as "NG", and the test was discontinued at that stage.

Test Nos. 1 to 6 are concerned with the results in the case where the diamond fine particle is externally added.

Test Nos. 1 to 3 are concerned with the results of the photoconductor A (having a charge injection layer), and satisfactory images were obtained over printing of 70,000 sheets. Furthermore, Test Nos. 4 to 6 are concerned with the results of the photoconductor B (not having a charge injection layer); and in all of these samples, though the generation of charging unevenness (in a streak state) was observed from the initial stage but not on an intolerable level, the subject state could be then kept over printing of 70,000 sheets, and as a result, the test of 70,000 sheets could be cleared.

On the other hand, in the examples of Test Nos. 7 and 8 not containing a diamond fine particle, in a combination (No. 7) with the photoconductor A (having a charge injection layer), the generation of streaks was slightly observed from the initial stage; and in a combination (No. 8) with the photoconductor B (not having a charge injection layer), uniform charging could not be achieved from the initial stage. Even in Test No. 7, when the test was continued, the image quality was deteriorated step by step and after printing of 50,000 sheets, became "NG". At that time, when the development unit was exchanged by a new development unit, the image quality was recovered to a level substantially equal to that at the initial stage.

That is, it is understood that when a diamond fine particle-free charging auxiliary particle is used, the performance of the developing agent within the development unit is degraded, resulting in degradation of the image quality, whereas a diamond fine particle-containing charging auxiliary particle is used, such degradation is not caused.

The foregoing results were also obtained in the case of internally adding a diamond fine particle. As demonstrated in Test Nos. 9 to 14, according to the results of the photoconductor A (having a charging injection layer) (Nos. 9 to 12), satisfactory images were obtained over printing of 70,000 sheets. Furthermore, Test Nos. 13 to 14 are concerned with the use of the photoconductor B (not having a charging injection layer); and in all of these samples, though the generation of charging unevenness (in a streak state) was observed from the initial stage but not on an intolerable level, the subject state could be then kept over printing of 70,000 sheets, and as a result, the test of 70,000 sheets could be cleared.

On the other hand, in the examples of Test Nos. 15 and 16 not containing a diamond fine particle, in a combination (No. 15) with the photoconductor A (having a charge injection layer), the generation of streaks was slightly observed from the initial stage; and in a combination (No. 16) with the photoconductor B (not having a charge injection layer), uniform charging could not be achieved from the initial stage. Even in Test No. 15, when the test was continued, the image quality was deteriorated step by step and after printing of 50,000 sheets, became on an intolerable level. At that time, when the developing agent in the development unit was exchanged by a new developing agent, the image quality was recovered to a level (a1) substantially equal to that at the initial stage.

Test Nos. 17 to 25 in FIG. 9 are concerned with the results of review by changing the rotation rate of the charging roller 102 in the Example of externally adding a charging auxiliary particle. The charging auxiliary particle the same as in Test No. 5 was used; and the B type not having a charging injection layer was used as the photoconductor.

According to this, in the case where the rotation direction of the charging roller 102 is the "with" direction against the photoconductor, when the rotation rate of the charging roller 102 is set up relatively faster by 1.1 to 3 times than that of the photoconductor, the same performance is obtained in all of the tests. Furthermore, even when the rotation rate of the charging roller 102 is set up relatively slow as in Test No. 21, the same performance is obtained. However, it is understood that when the charging roller 102 is rotated at a rate of 1.0 time or in a coupled driving system, though the performance is, as a matter of course, improved as compared with the case of using a charging auxiliary particle of the related art, the level of charging unevenness becomes worse as compared with the case of giving a circumferential speed difference. Furthermore, with respect to the "against" direction against the photoconductor, it is understood that when the rotation rate of the charging roller 102 is set up at from approximately 0.5 to 3 times, a satisfactory performance the same as in the "with" direction is obtained. It can be said from the foregoing that it is preferred to rotate and drive the charging roller in such a manner that the roller surface of the charging roller has a prescribed difference in speed against the photoconductive surface of the photoconductor.

Furthermore, in Test No. 25, a brush roller (see FIG. 7) was used in place of the charging roller.

A brush roller made of nylon (UUN) was used. As to the thickness of fiber, though those of from 0.5 to 10 dtex can be used, one of 2 dtex was used herein. The brush roller was rotated at a rate of 2 times in the "with" direction in the contact section of the photoconductor, and a charging auxiliary particle the same as in Test No. 5 was supplied by using the supply roller 101 in the same manner as in the case of the elastic roller. According to this, it is understood that the same results as in the case of the charging roller are obtained; that the test of 70,000 sheets is cleared; and that even by using a brush roller as the charging member, the same results are obtained.

Next, FIG. 10 shows the results of review by changing the surface energy of each of the supply roller surface of a charging auxiliary particle, the charging roller surface and the photoconductive surface. The surface energy can be relatively compared by measuring a contact angle against water. The results as shown in FIG. 10 are concerned with the respective measurement results and life test results. A charging auxiliary particle the same as in Test No. 5 was used; a circumferential speed difference against the photoconductor was 2.0 times in the "with" direction; and the B type not having a charging injection layer was used as the photoconductor.

In Test No. 26 in which the surface energy of the charging roller surface is slightly lower than that in Test No. 5, since the permutation itself does not change, the same performance as in Test No. 5 was obtained. However, in the case where the contact angle of the supply roller is smaller than that of the charging roller (the surface energy is low), since the charging auxiliary particle from the supply roller to the charging roller side cannot be satisfactorily supplied, the performance is deteriorated. Furthermore, in Test Nos. 29 and 30 in which the contact angel of the photoconductive surface is smaller than that of the charging roller surface (the surface energy is low), since the charging auxiliary particle moves from the charging roller to the photoconductor, it is understood that the deterioration of the charging performance is remarkable.

In the light of the above, it is preferable that the following requirements are met.

(Contact angle of photoconductive surface against water)> (Contact angle of charging roller surface against water)

(Contact angle of charging roller surface against water)< (Contact angle of charging auxiliary particle supply roller surface against water)

In particular, it is understood that the influence of the former is large.

It has been thus found that by using the charging device using a charging auxiliary particle according to the invention, the charging efficiency is markedly improved as compared with the related art. Also, it has been proven that even when the charging auxiliary particle is intermixed into the development unit, since it does not deteriorate the characteristics of the developing agent, the stable image quality can be guaranteed over a long period of time.

This effect is also brought in the case of mixing a charging auxiliary particle in a toner in advance and using the mixture. That is, even when a prescribed amount of the charging auxiliary particle is mixed in a developing agent in advance, the charging characteristics of the developing agent itself and so on are not influenced as compared with the related-art auxiliary particle, and therefore, it may be said that an image with high image quality can be explicitly achieved from the initial stage.

In addition, the foregoing characteristics of the charging auxiliary particle are obtained due to the characteristics of the diamond fine particle, and needless to say, the same effects are obtainable even by using the diamond fine particle singly as the charging auxiliary particle. However, since according to the single use of the diamond fine particle, there is a limit in adjusting the specific resistivity, an external addition or internal addition formulation was applied in the present Example. Recently, with respect to the diamond fine particle, particles having a varied specific resistivity have become available due to a degree of mixing of impurities, and particles having a specific resistivity of not more than 1×10e12 Ω·cm can be used singly, too.

Furthermore, in addition to the foregoing effects, in particular, when the charging auxiliary particle is used in a cleaner-less process, by stably polishing the photoconductor, an effect for preventing an adhesion phenomenon of a toner or an external additive onto the photoconductive surface can be expected. Next, a verification experiment regarding this is described.

Figure 11:
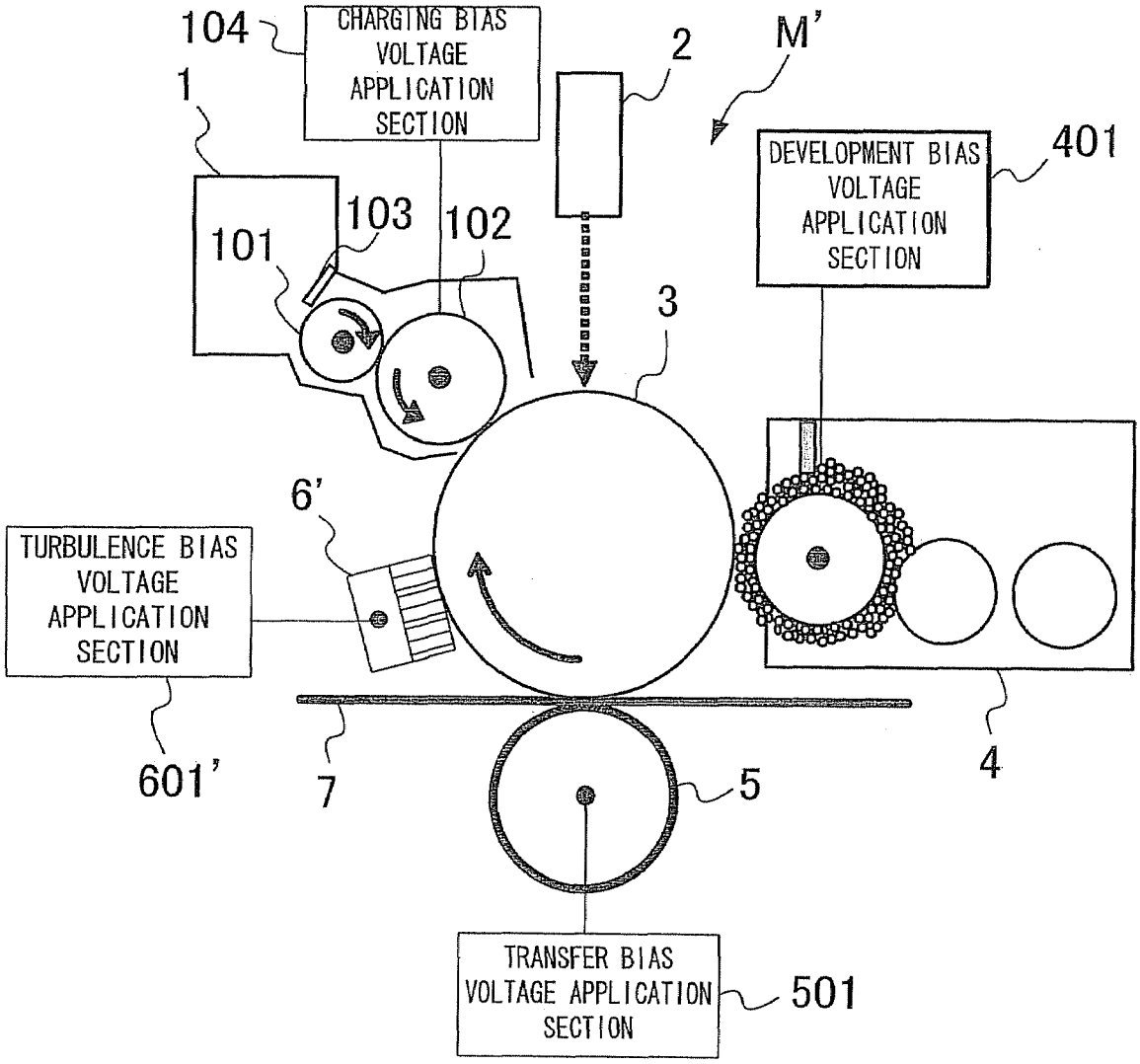
FIG. 11 is a view to show a configuration of other electrophotographic apparatus (image forming apparatus) M' provided with a charging device 1 of a contact charging system according to an embodiment of the invention.

In the experiment, an image forming apparatus M' having a process configuration as illustrated in FIG. 11 was used. The photoconductor cleaner was omitted, and a fixing type brush 6' to which a turbulence bias voltage of DC+600 V is applied by a turbulence bias voltage application section 601' was arranged in that position. This brush 6' disturbs a pattern of the residual transferred toner remaining on the photoconductor without being transferred and stably arranges the charging polarity of the toner in a plus direction. A brush made of nylon having a fiber length of 4 mm and a fiber thickness of 4 dtex is used as the brush 6'. This brush has a resistivity of from 1×10e4 to 10 e7 Ω·cm, the value of which is a value obtained by applying 300 V in a state of pressing it onto a metal plate at a load of 500 g and measuring a current value at that time.

According to such an apparatus configuration, the residual transferred toner is charged plus by the brush and attaches to the charging roller. Here, the charging roller 102 of the present embodiment comes into contact with the photoconductor via the charging auxiliary particle. Thus, since the injection charging characteristics are excellent, the toner is rapidly charged into minus polarity as regular charging polarity within a short time and sent out on the photoconductor.

In the development unit 4, the thus sent out toner is recovered into the development unit 4 in a non-image part, and an image part remains on the photoconductive drum 3 as a developed image as it is. Here, in usual charging auxiliary particles, since it is impossible to rapidly charge the residual transferred toner minus, the charging roller 102 is stained, and the charging performance is lowered. However, in the charging auxiliary particle according to the present embodiment, such a phenomenon is not caused.

Furthermore, in the cleaner-less process, since a cleaner blade is not present and a member for shaving the photoconductor is not provided, so-called "photoconductor filming" in which the toner or the separated external additive adheres to the photoconductor easily occurs. However, by using the charging auxiliary particle according to the present embodiment, since the diamond fine particle stably polishes the photoconductive surface, the filming hardly occurs.

The evaluation was carried out by the same method as in the preceding experiment. In the case where a cleaner is provided, the test was carried out without using paper. On the other hand, in the present case, since a cleaner is not provided, the test was carried out by actually passing paper.

With respect to the evaluation items, in addition to the foregoing "a" and "c", "b" regarding an image defect caused due to the filming was added. That is, when a halftone image, a white image or a solid image was printed in the same manner as in the preceding test and streaks or white spots were generated, the photoconductive surface was visually confirmed; and the case where a deposit was observed in a position corresponding to the image was defined as filming "b". In that case, the level on which the generation of streaks or white spots was observed but was tolerable is designated as "b1" or "b2"; and the level on which the generation of streaks or white spots was intolerable is designated as "b3".

Furthermore, the film shaving amount of the photoconductor was measured. The film shaving amount was measured by using an eddy-current type film thickness meter, manufactured by Ket Electronics Co., Ltd. The measurement was performed 30 times while arbitrarily altering the position, and an average value of measured values of 20 times from the center was defined as a film thickness, thereby measuring how the film was shaven from the photoconductor of the initial state. The results obtained are shown in FIG. 12.

With respect to the related-art charging auxiliary particle made of only zinc oxide, in the combination with the photoconductor A (having a charge injection layer), the image state was on the "a1" level from the initial stage, and after printing of approximately 10,000 sheets, filming occurred, and the image state was on the "b1" level. In addition, after printing of 20,000 sheets, both the streaks and the filming progressed, and the image state reached the "level 2"; and after printing of 30,000 sheets, the image state reached an intolerable level.

On the other hand, in the case of the charging roller using the charging auxiliary particle of the invention, as shown in Test Nos. 33 and 34, in all of the photoconductors A and B, after printing of 50,000 sheets, the image state did not reached an intolerable level.

With respect to the film shaving amount of the photoconductor, in Test No. 34, it becomes an approximately half value as compared with the case of using a blade cleaner (Test No. 5; see the lowermost row in the table of FIG. 12). In the light of the above, according to the present embodiment, even in the case of employing a cleaner-less process, the charging unit is hardly stained, and the generation of filming of the photoconductor can be prevented without largely shaving the photoconductor, an aspect of which is an original purpose of the cleaner-less process.

In particular, such effects became remarkable in the case of using a material in which the photoconductive surface is hardly shaven. When an inorganic photoconductor containing a-Si as a major component or a hole transporting material containing a chain polymerizable functional group is used as the photoconductor with high durability, the surface hardness of the photoconductor is high so that scratches are hardly formed, and a long life of the photoconductor is achieved. In using such a photoconductor, when the charging auxiliary particle of the invention is used, the adhered toner component is stably removed from the photoconductor without substantial shaving of the photoconductor itself, whereby the filming of the photoconductor can be prevented.

FIG. 12 shows the test results of the case using each of the photoconductors in Test Nos. 35 and 36. In the present tests, since the charge injection layer is not provided, though the image state is on the "a1" level from the initial stage, it is understood that it is possible to achieve stable injection charging and that the test of 50,000 sheets is cleared in a state that the photoconductor is not substantially shaven.

Incidentally, in the image forming apparatus according to the present embodiment, the photoconductive drum 3 and at least one of the charging device 1 and the development unit 4 are integrally supported as a process unit U, which is made attachable to or detachable from the main body of the image forming apparatus 1.

As illustrated in FIG. 1, in the present embodiment, the process unit U is provided with the photoconductive drum 3, the charging device 1 and the development unit 4 as one example. As a matter of course, the process unit U can also be configured to include other portions than the foregoing in response to a space restriction in the image forming apparatus or the arrangement of parts or the like.

Furthermore, in the foregoing embodiments, while the image forming apparatus which is of an intermediate transfer system for temporarily transferring a toner image formed on a photoconductor onto an intermediate transfer belt has been described as an example, it should not be construed that the invention is limited thereto. The image forming apparatus may be of other intermediate transfer system for temporarily transferring a toner image formed on a photoconductor onto an intermediate transfer roller or of a direct transfer system for directly transferring a toner image on a photoconductor onto a sheet.

Furthermore, with respect to the development system of toner image, a so-called quadruple tandem system for forming a toner image of plural colors at once on an intermediate transfer body rotating once, a four-rotation intermediate transfer system for successively forming a toner image of each color on an intermediate transfer body rotating four times, and the like can be employed.

Furthermore, in the foregoing embodiments, while the configuration of supplying a charging auxiliary particle to a charging member by a supplying roller (configuration of supplying a charging auxiliary particle onto a charging roller surface by a supply roller and carrying the charging auxiliary particle to a charging position by the charging roller itself) has been described as an example, it should not be construed that the invention is limited thereto. In particular, in the configuration as illustrated in FIG. 6, the charging auxiliary particle may be directly supplied to the position at which the charging member comes into contact with the photoconductive drum by using a conveyance unit such as an auger and a roller.

For example, by bringing a mechanism for supplying the charging auxiliary particle to the charging roller into contact with the photoconductive surface as it is and achieving it just before a charging unit (for example, a blade), the photoconductive surface to which the charging auxiliary particle adheres penetrates into the charging section; and a part of the charging auxiliary particle remains in the charging section, whereas the non-residual charging auxiliary particle passes therethrough. In any way, the charging auxiliary particle is thoroughly supplied in the charging section. On that occasion, in particular, in the case where the photoconductor is in a drum shape, the supply roller of the charging auxiliary particle is preferably an elastic roller taking into consideration the contact.

Furthermore, according to the present embodiment, for the purpose of charging the image-carrying surface of the image carrier, there can be provided a charging method of supplying a charging auxiliary particle made of a conductive particle having a diamond particle contained therein in a portion of a charging member coming into contact with an image carrying surface of an image carrier which comes into contact with the image carrying surface for charging the image carrying surface; and applying a prescribed bias voltage to the charging member in a state that the charging auxiliary particle is mediated between the charging member and the image carrier, thereby charging the surface of the image carrier.

A charging auxiliary particle of the related art was a particle such as a single body of a metal oxide such as zinc oxide or a compound thereof, and a resin mixed or coated with carbon black, etc. On the other hand, since the diamond fine particle has a strong characteristic of charging a contacted subject to negative polarity, not only it exhibits good injection charging characteristics, but also even when intermixed in the development unit, it does not largely influence a toner so far as the charging characteristic of the toner is negative polarity.

Furthermore, the diamond fine particle has a stable polishing action because of its high hardness. In particular, in the case where the diamond fine particle is employed in a cleaner-less process, the generation of adhesion (filming) of the toner component, the separated toner external additive and the like to the photoconductive surface can be inhibited, and the exchange life of the photoconductor can be prolonged.

By using a contact charging unit using the charging auxiliary particle according to the invention, it is possible to stably charge the photoconductor at a low applied voltage. In addition, even when the charging auxiliary particle is intermixed in the development unit, it does not substantially influence the characteristics of the developing agent. Accordingly, it is possible to keep a stable high image quality over a long period of time.

Moreover, it is possible to prevent a filming phenomenon in which a wax component in the toner, the separated external additive and the like adhere to the photoconductive surface from occurring due to a polishing action against the photoconductive surface. In particular, it is effective to use the charging auxiliary agent according to the invention in a cleaner-less process.

In the light of the above, according to the present embodiments, it is possible to provide a charging technology using a charging auxiliary particle, in which injection charging can be achieved more stably; even when a charging auxiliary particle is mixed in a development unit, so far as its amount is a little, it does not substantially influence charging characteristics of a toner and the like.

While the invention has been described in detail and with reference to specific embodiments thereof, it will be apparent to one skilled in the art that various changes and modifications can be made therein without departing from the spirit and scope thereof.

As described above in detail, according to the invention, it is possible to provide a technology capable of realizing a stable charging performance in an image forming apparatus employing a contact charging system.

What is claimed is:

1. A charging device, comprising:

a rotatably supported charging roller to which a prescribed bias voltage is applied and which comes into contact with an image carrying surface of an image carrier to charge the image carrying surface; and a rotatably supported particle supply roller which is disposed close to or in a surface of the charging roller and which is configured to directly supply the charging roller with a charging auxiliary particle made of a conductive particle having a diamond particle contained therein, wherein when a gap between a roller surface of the supply roller and a roller surface of the charging roller in a position at which both rollers are close to each other is defined as G and a diameter of the charging auxiliary particle is defined as Td, the following relationship is set up:

$$G \leqq (2 \times Td).$$

2. The charging device according to claim 1, wherein the supply roller is rotated and driven in such a manner that a roller surface of the supply roller and a roller surface of the charging roller move in the same direction in a portions where the two roller surfaces are close to each other.

3. The charging device according to claim 1, wherein
a rotation axis of the supply roller is arranged at a position higher than a rotation axis of the charging roller but lower than a maximum arrival position of the outer periphery of the charging roller in a height direction.

4. The charging device according to claim 1, wherein
when a radius of the supply roller is defined as Rs and a radius of the charging roller is defined as Rt, (Rt/Rs) is set up so as to fall within the range of from 1 to 1.6.

5. The charging device according to claim 1, wherein
the regular charging polarity of the toner as a developing agent forming an image on the image carrier is minus polarity.

6. The charging device according to claim 1, wherein
a contact angle of a surface of the charging member against water is smaller than a contact angle of an image carrying surface of the image carrier against water.

7. The charging device according to claim 1, wherein
the charging auxiliary particle is a particle obtained by subjecting a conductive particle to an external addition treatment with a diamond particle.

8. The charging device according to claim 1, wherein
the charging auxiliary particle is a particle obtained by dispersing a diamond particle in a conductive particle.

9. The charging device according to claim 1, wherein
a contact angle of a roller surface of the supply roller against water is larger than a contact angle of a roller surface of the charging roller against water.

10. The charging device according to claim 1, wherein
the charging roller is rotated and driven in such a manner that a roller surface of the charging roller has a prescribed difference in speed against an image carrying surface of the image carrier.

11. An image forming apparatus, comprising:
the charging device according to claim 1; and
an image carrier carrying a toner image thereon, which is formed of a material containing amorphous silicon or a hole transporting material containing a chain polymerizable functional group.

12. An image forming apparatus, wherein
the charging device according to claim 1 and the image carrier are integrally supported as a process unit and are attachable to or detachable from the image forming apparatus.

* * * * *